US009340932B2

(12) United States Patent
Meier

(10) Patent No.: US 9,340,932 B2
(45) Date of Patent: May 17, 2016

(54) SOIL COMPACTOR WITH STORAGE SPACE

(71) Applicant: Hamm AG, Tirschenreuth (DE)

(72) Inventor: Matthias Meier, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 0 days.

(21) Appl. No.: 14/200,887

(22) Filed: Mar. 7, 2014

(65) Prior Publication Data

US 2014/0301785 A1 Oct. 9, 2014

(30) Foreign Application Priority Data

Mar. 7, 2013 (DE) ..... 10 2013 203 860

(51) Int. Cl.
*E01C 19/26* (2006.01)
*E01C 19/28* (2006.01)
*E01C 19/23* (2006.01)

(52) U.S. Cl.
CPC ..... *E01C 19/28* (2013.01); *E01C 19/23* (2013.01); *E01C 19/236* (2013.01); *E01C 19/26* (2013.01); *E01C 2301/40* (2013.01)

(58) Field of Classification Search
CPC ..... B60R 3/02; B60R 5/02
USPC ..... 404/122, 128, 130; 296/24.45, 37.1, 296/37.6
See application file for complete search history.

(56) References Cited

U.S. PATENT DOCUMENTS 2,626,179 A * 1/1953 Gonzalez ..... B60R 5/041 224/542
2,901,285 A * 8/1959 Walker ..... B62D 25/12 296/37.1
3,221,619 A * 12/1965 Erickson ..... 404/112
3,900,272 A 8/1975 Domenighetti
4,405,177 A * 9/1983 Yamashita ..... 299/41.1
5,312,150 A * 5/1994 Quam ..... B62D 33/0273 296/57.1
5,511,901 A * 4/1996 Yates ..... 404/124
6,460,915 B1 * 10/2002 Bedi ..... B60J 5/0498 296/151
7,086,689 B2 * 8/2006 Dean ..... B60J 5/0487 296/182.1

(Continued)

FOREIGN PATENT DOCUMENTS

CN 202345790 U 7/2012
DE 2351537 10/1973

(Continued)

OTHER PUBLICATIONS

Search Report of the German priority application DE 10 2013 203 860.7 dated Oct. 1, 2014, 4 pages.

(Continued)

*Primary Examiner* — Thomas B Will
*Assistant Examiner* — Katherine Chu
(74) *Attorney, Agent, or Firm* — Rothwell, Figg, Ernst & Manbeck, P.C.

(57) ABSTRACT

A soil compactor, comprising a compaction roller (16) supported on a compaction frame (14) and rotatable around a rotational axis (D), wherein the compaction frame (14) comprises longitudinal frame areas on both sides of the compaction roller (16) in direction of the rotational axis (D) and a first cross frame area (34) connecting the longitudinal frame areas (30, 32) to each other and extending essentially in the direction of the rotational axis (D) is characterized in that at least one storage space (38) is provided in the first cross frame area (34), which is closed by means of a locking element (50) movable between a closed position and an open position.

9 Claims, 5 Drawing Sheets

(56) References Cited

U.S. PATENT DOCUMENTS

| | | | | |
|---|---|---|---|---|
| 7,118,150 | B2 * | 10/2006 | Bruford et al. | 296/37.1 |
| 7,686,365 | B2 * | 3/2010 | Thelen | B60R 9/00 220/480 |
| 7,950,728 | B2 * | 5/2011 | Plavetich | B60R 9/00 108/44 |
| 8,201,869 | B1 * | 6/2012 | Butlin, Jr. | B60R 3/02 296/57.1 |
| 8,348,325 | B2 * | 1/2013 | Hausler | B62D 33/0273 296/51 |
| 2005/0264048 | A1 * | 12/2005 | Collins | B60N 2/3095 297/188.01 |

FOREIGN PATENT DOCUMENTS

| | | | |
|---|---|---|---|
| DE | 102005015861 | A1 | 10/2006 |
| DE | 102011085240 | A1 | 5/2013 |
| JP | 2007152999 | A | 6/2007 |

OTHER PUBLICATIONS

Search Report for corresponding European application No. 14156684.4 along with English translation dated Jun. 20, 2014, 10 pages.

Office Action issued for Chinese patent application No. 201410030867.1 dated Aug. 14, 2015 (5 pages).

* cited by examiner

SOIL COMPACTOR WITH STORAGE SPACE

The invention relates to a soil compactor comprising a compaction roller supported on a compaction frame and rotatable around a rotational axis, wherein the compaction frame comprises longitudinal frame areas on both sides of the compaction roller in direction of the rotational axis and a first cross frame area connecting the longitudinal frame areas to each other and extending essentially in direction of the rotational axis.

Such a soil compactor is known, for example, from the subsequently published patent document DE 10 2011 085 240 A1. The compaction frame, which rotatably supports the compaction roller, forms at the same time essentially a front end of the soil compactor, which is pivotably connected to a rear end. A drive unit is provided at the rear end, which transfers a drive force to the drive wheels, which are likewise provided at the rear end, and also makes available the operating power for a vibration and/or oscillation mechanism provided in a compaction roller. A driving cab is also provided at the rear end. The pivotable arrangement of the front end, that is, the compaction frame, on the rear end, makes possible the steering of the forward and rearward movement of the soil compactor.

It is the object of the invention to provide a soil compactor in which the available installation space is efficiently utilized.

This object is attained according to the invention by means of a soil compactor comprising a compaction roller supported on a compaction frame and rotatable around a rotational axis, wherein the compaction frame comprises longitudinal frame areas on both sides of the compaction roller in direction of the rotational axis and a first cross frame area connecting the longitudinal frame areas to each other and extending essentially in direction of the rotational axis.

It is also provided that at least one storage space, which can be locked by means of a locking element that can be moved between a closed position and an open position, is provided in the first cross frame area.

The space available in the compaction frame, which is generally configured as a hollow component, is utilized in the embodiment according to the invention to make available a storage space. Tools or another material, such as, for example, also a ballast material, can be stored in this storage space, insofar as this is required and advantageous for the operation of the soil compactor.

In a very stable embodiment, which can have a very simple design, the locking element is preferably a closure lid pivotable between an open position and a closed position, wherein the closure lid is furthermore preferably pivotably supported on the first cross frame area.

In order to be able to store larger objects in the storage space or attain easy access to the inner volume of the storage space, it is furthermore proposed that the at least one storage space is open in upward direction by means of an upper opening area and in the direction facing away from the compaction roller by means of a lateral opening area, and that the locking element comprises a first locking element section that locks the lateral opening area in closed position and a second locking element section that is or can be bent at an angle with respect to the first locking element section, which locks the upper opening area in the closed position.

In such an embodiment, the first locking element section can be pivotably connected, for example, to the first cross frame area, preferably in an area underneath the lateral opening area.

An increased functionality can be achieved with the design according to the invention, if the second locking element area is essentially horizontally oriented when the locking element is in open position. The locking element can in this way be utilized as a work step in its open position. An operator can utilize this work step, for example, in order to load or remove objects into or from the at least one storage space or to perform maintenance work on the compaction roller or the compaction frame.

At least one actuator operated with a compressed fluid can be allocated to the locking element for the purpose of moving said locking element between the closed position and the open position. This allows the use of comparatively large or compact locking elements.

According to another aspect of the invention, a work step that can be moved between a stowing position and a working position can be provided in the first cross frame area in a generic compactor or also a soil compactor according to the invention.

Such a work step creates the possibility of performing maintenance work, for example, on the outer periphery of the compaction roller also in comparatively large soil compactors.

The work step can at the same time lock a storage space provided in the first cross frame area in its stowing position, so that the work step can make available not only this function, but also the function of a locking element for the at least one storage space.

It is furthermore proposed to provide at least one holding handle on the first cross frame area and extending preferably in direction of the rotational axis in order to provide an operator standing and performing maintenance work, for example, on the compaction roller, with stability when standing high up.

In order to help a person steering an inventive soil compactor to stay within the lane, for example, with the aid of a line that delimits or runs through the soil area to be compacted, it is proposed that at least one lane indication element can be mounted so as to displace on at least one holding handle in the longitudinal direction of the holding handle.

The inventive soil compactor can furthermore be configured in such a way that the longitudinal frame areas are connected to each other by a second cross frame area, and the compacting roller is positioned between the first cross frame area and the second cross frame area, wherein the second cross frame area is preferably pivotably connected to a rear end, and a drive unit and/or a driving cab is provided at the rear end.

It can be further provided that a preferably exchangeable roller tool is or can be positioned on the outer surface of the compaction roller. The compaction roller can be adapted for different intended uses by providing tools on the outer periphery of said compaction roller, in particular when these tools can be exchanged.

The invention will be described in more detail in the following with reference to the enclosed figures, wherein.

Figure 1:
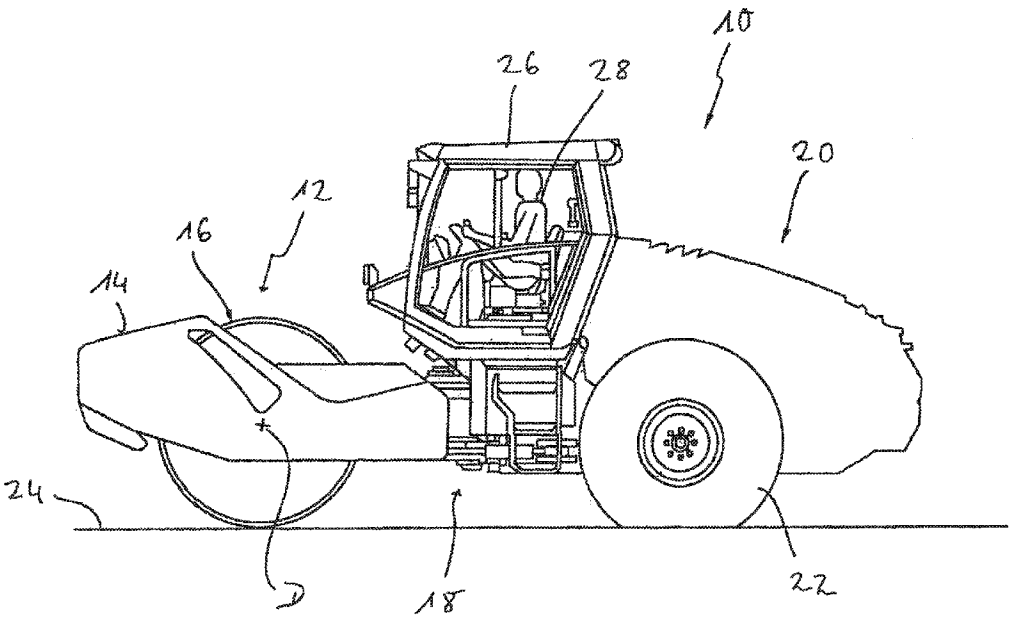
FIG. 1 Shows a lateral view of a soil compactor.

A soil compactor represented in lateral view in FIG. 1 is generally identified with reference numeral 10. The soil compactor 10 comprises a front end 12 having a compaction roller 16 supported on a compacting frame 14 and rotatable around a rotational axis D. The front end 12 is pivotably connected to the rear end 20 in an articulated area 18 and can be pivoted with reference to the latter around an essentially vertically oriented pivot axis. A drive unit, by means of which two drive wheels 22 provided at the rear end 20 can be driven in order to move the soil compactor 10 over the ground 24 to be processed, is provided at the rear end 20. This drive unit can at the same time also make available the operating power for driving a vibration and/or oscillation mechanism provided in the compaction roller 16. A driving cab 26, in which an operator 28 steering the compactor 10 can position himself, is furthermore provided at the rear end 20.

Figures 2, 7:
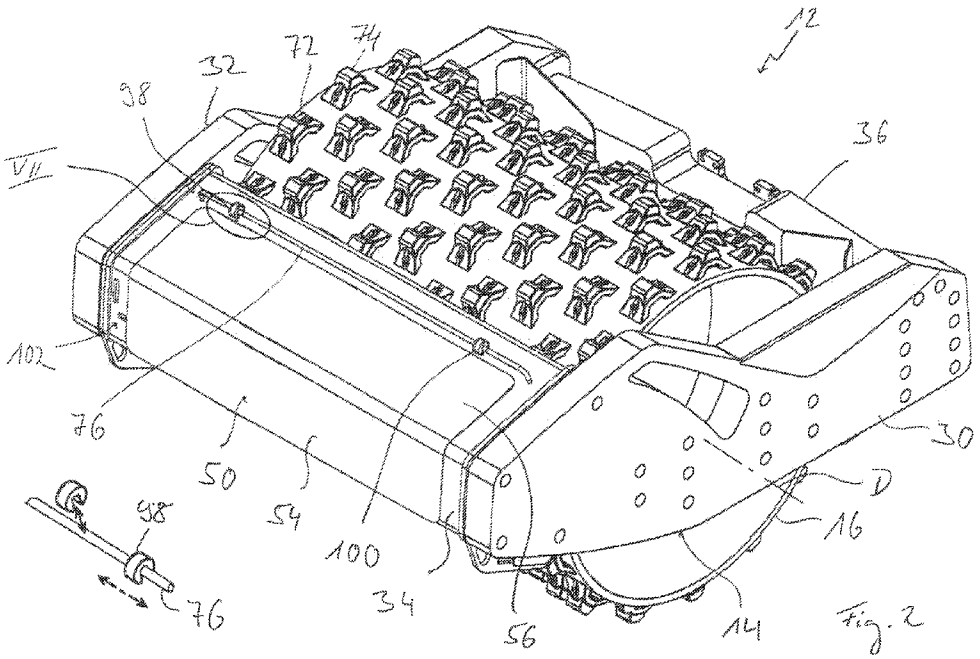
FIG. 2 Shows a perspective view of a front end of a soil compactor with a locking element positioned in closed position.
FIG. 7 Shows an enlargement of detail VII of FIG. 2.
Figure 3:
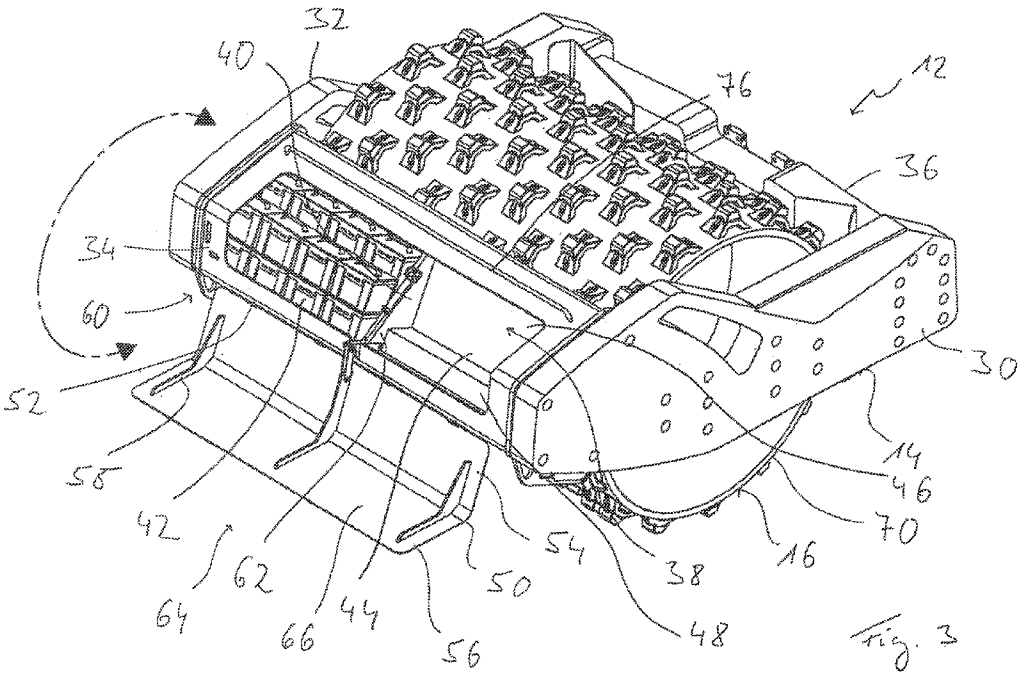
FIG. 3 Shows the front end of FIG. 2 with a locking element positioned in open position.

FIGS. 2 and 3 show a perspective representation of the front end 12 of the soil compactor 10 seen from the front side. The front end 12 comprises two longitudinal frame areas 30, 32, which are located on both sides of the compaction roller 16, that is, they are axially spaced with respect to each other in direction of the rotational axis D. These are connected to each other by means of a first cross frame area 34, which extends between the two longitudinal frame areas 30, 32 essentially in the direction of the rotational axis D, at their end area located farthest from the rear end 20. The two longitudinal frame areas 30, 32 are connected to each other by means of a second cross frame area 36 at their end area that faces toward the rear end 20, so that the compaction roller 18 is positioned essentially transversely to the rotational axis D between the first cross frame area 34 and the second cross frame area 36. The front end 12 or the compaction frame 14 thereof is pivotably connected to the rear end 20 with the second cross frame area 36.

A storage space, which is generally identified with reference numeral 38, is configured in the first cross frame area 34. The latter is subdivided into two storage space sections 42, 44 by means of a partition wall 40. The storage space 38 is essentially open in an upward direction by means of an upper opening area 46. The storage space 38 is open by means of a lateral opening area 48 essentially in the direction facing away from the compaction roller 16, that is, forward with reference to a forward driving direction.

A locking element 50 configured as a closure lid is pivotably mounted on the first cross frame area 34 in an area located underneath the lateral opening area 48. Several articulations or hinges 52 arranged one after the other in the direction of the rotational axis D can be used for this purpose. The locking element 50 comprises, for example, a first looking element section 54 having an essentially plate-shaped configuration. The latter is pivotably supported by means of hinges 52 or the like on the first cross frame area 34. A second locking element section 56 extends essentially at an angle with respect to the first element section 54, for example at an angle of approximately 90°. The two locking element sections 54, 56 can be configured as separate plate elements, which can be joined, for example, by means of welding. The locking element 50 can basically also consist of a plate part, which makes available the two locking element sections 54, 56 and is bent in the required shape. In order to increase the structural stability of the locking element 50, several angular reinforcement elements 58 can also be pivotably connected to each other, for example, by means of welding, in the direction of the rotational axis D, and at a distance from each other to the two locking element sections 54, 56. As an alternative, the two locking element sections 54, 56 are also mutually connected to each other so as to pivot, wherein then further measures can be provided, which ensure that the two locking element sections 54, 56 are held together in a defined position at an angle with respect to each other, for example, the position that can be seen in FIG. 3, if the locking element 50 is positioned in the open position.

Two actuators 60, 62 are associated in the depicted example with the locking element 50 in order to be able to move the locking element 50 between its closed position shown in FIG. 2 and its open position shown in FIG. 3. The actuator 60 can engage in the process in a longitudinal end area—with respect to the rotational axis D—while the actuator 62 can engage in a longitudinal central area. The actuators 60, 62 can be actuated by means of compressed fluid, that is, they can comprise, for example, a piston/cylinder element that can be actuated with compressed air or compressed oil and has a dual action, which is directly or indirectly supported on the locking element 50, on the one hand, and on the compaction frame 14, on the other hand, and can move the locking element 50 back and forth between the positions depicted in FIGS. 2 and 3 by means of a compressed fluid supply or compressed fluid discharge. At the same time, at least one of these actuators 60, 62 can also serve to stably lock in place the locking element 50 in the closed position or also in the open position, so that the storage space 38 is reliably secured against unauthorized manipulation when the locking element is positioned in the closed position, and is stably held in the open position and secured against any undefined pivoting movement when the locking element 50 is in the open position. It is of course also possible, if required, to hold or lock in place the locking element 50 in an intermediate position between the closed and the open position.

Figure 4:
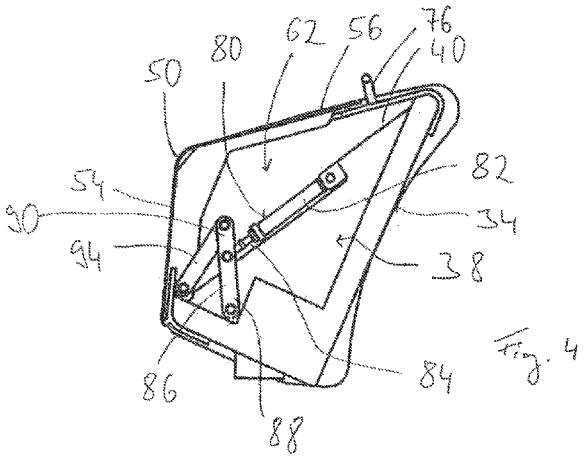
FIG. 4 Shows a cross sectional view of a cross frame area with the locking element positioned in closed position.
Figure 5:
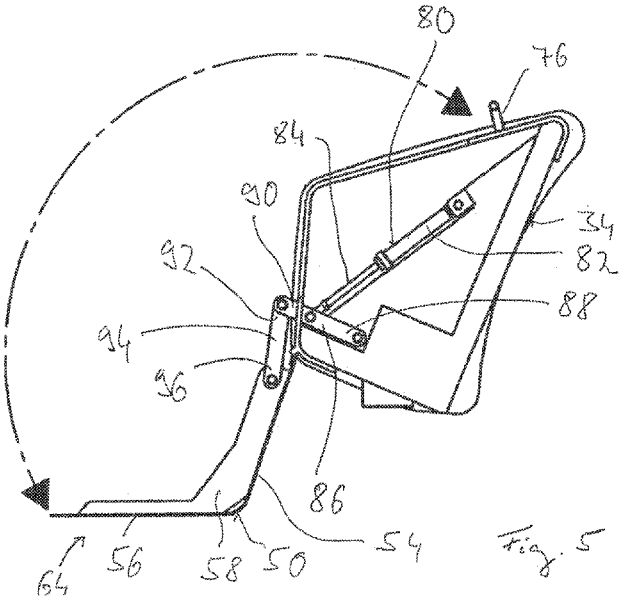
FIG. 5 Shows a depiction corresponding to FIG. 4 with the locking element positioned in open position.

FIGS. 4 and 5 show the configuration or also the mode of operation of an actuator with the aid of the actuator 62. The actuator 62 comprises a piston/cylinder element 80, which can be hinge-connected, for example, to an end area of its cylinder 82 on the cross frame area 34, for example, the partition wall 40. The piston/cylinder element 80 can be hinge-connected to an end of the piston rod 84 with a first pivot lever 86, for example, in an area between its two end areas 88, 90. A first end area 88 of the pivot lever 86 is pivotably mounted, for example, in the area of the partition wall 40. A second end area 90 is hinge-connected to a first end area 92 of a second pivot lever 94. Its second end area 96 is hinge-connected to the locking element 50 and, namely, eccentrically with respect to the pivot axis thereof. When the piston/cylinder element 80 is acted on with compressed fluid in order to move out the piston rod 84, the locking element 50 is thus moved into the open position, which is also depicted in FIG. 5. With a reverse actuation of the piston/cylinder element 80, the locking element 50 is pivoted into the closed position depicted in FIG. 4.

It should be noted that the actuator provided in the end area of the locking element can of course also be correspondingly configured or that such an actuator or also an actuator with another type of configuration could also be alternatively or additionally provided on another longitudinal end area of the locking element.

A lock or similar lockable actuating unit 102 can be provided for reasons of security on a cross frame area 34, for example, in order to actuate the locking element 50 or the actuators 60, 62 that move said locking element between the open position and the closed position. Said actuating unit can be manipulated by an operator in order to elicit the required pivoting movement of the locking element 50. It is of course alternatively or additionally possible to provide such an actuating unit in the driving cab 26, so that an actuation of the locking element 50 can also take place from the driving cab 26.

Figure 6:
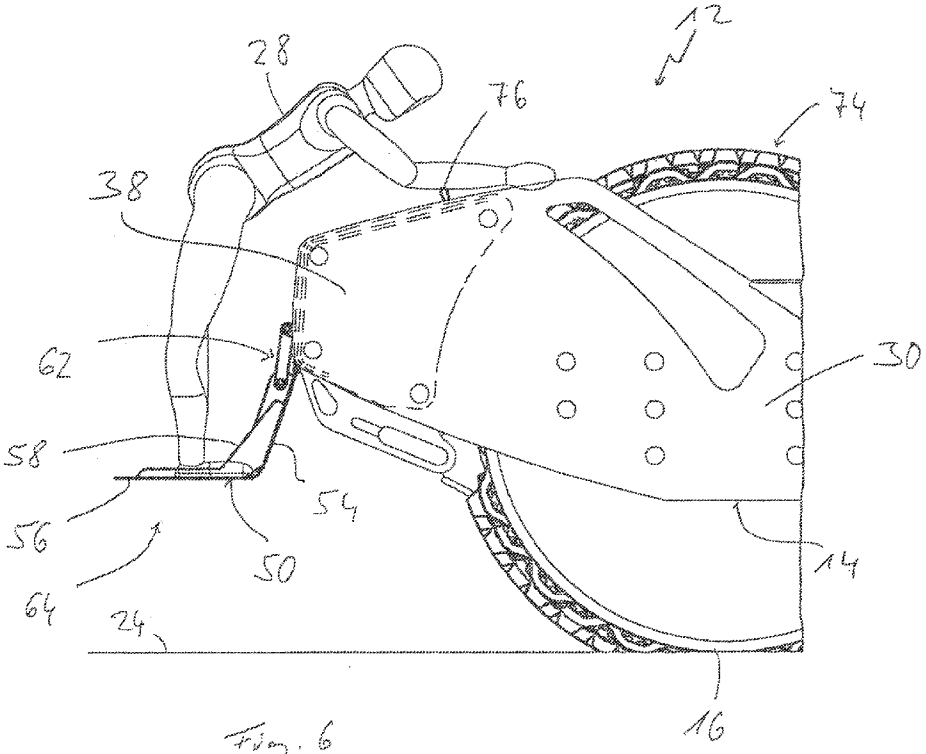
FIG. 6 Shows a lateral view of the front end with the locking element positioned in the open position and being utilized as work step.

When the locking element is positioned in the open position, the latter can also be used as a work step 64. A formation 66, for example, a corrugated plate or the like, which improves the stability of an operator, can be provided for this purpose, for example, on the side of the second locking element section 56 that faces toward the storage space 38 in the closed position. As is shown in FIG. 6, it becomes possible for an operator 28 standing on the second locking element 56 to load or unload material into or from the storage space 38, which is shown in FIG. 3 by means of a multitude of tool holders positioned in the storage space section 42 when the locking element 50 is positioned in the open position and is thus positioned in its working position as work step 64. It is also possible for the operator 28 to perform maintenance work, for example, on the compaction roller 16.

In the example depicted in the figures, the compaction roller 16 is configured on its outer periphery with a multitude of change holder systems 68 having a tool holder 72 fixed, for example, by welding, on a roller jacket 70 and a roller tool 74, for example, a chisel, which is respectively fixed, but in essence supported so as to release on the tool holder 72 for the compaction operation. Depending on the intended purpose of the work, it may be necessary to use different configurations for the roller tools 74, for which it may be necessary to remove roller tools 74 from the compaction roller 16 and replace these with others. This procedure can then be carried out comparatively easily if, as shown in FIG. 6, the operator 18 can stand on the work step 64, that is, the locking element 50 positioned in the open position. For this purpose, it is particularly advantageous if the second locking element section 56 is positioned approximately horizontally when the locking element 50 is positioned in open position, so that the operator 28 can stably stand thereon. The stability of the operator 28 can be further increased in that at least one holding handle 76 is provided on the compaction frame 14, preferably the first cross frame area 34. The latter can be configured, for example, extending continuously approximately over the entire extending length of the first cross frame area 34.

FIG. 7 shows another aspect that can be realized within the context of the inventive layout utilizing the holding handle 76 provided on the cross frame area 34. Two track indicators 98, 100 having, for example a clip-like configuration, are provided on the latter and can be displaceably mounted on the holding handle. These can be displaced in the longitudinal direction of the holding handle 76 and can be used to make available to the operator seated in the driving cab 26 a sighting device while steering the soil compactor 10. The track indicators 98 or/and 100 can be positioned on the holding handle 76 in the manner of a backlight in such a way that they target a defined line and edge area on the ground to be compacted or processed when observing from the driving cab 26, so that the operator is provided with the possibility of staying on the correct lane or checking the selected lane by means of repeated targeting via such a track indicator 98 or 100.

Reference is finally made to the fact that the principles of the invention can of course also be realized with another structural configuration. Separate mutually pivotable or movable locking elements, for example, which are associated with the two storage space sections 40, 42 can thus be provided. Several storage spaces lying, if necessary with one directly beside the other which can then be closed by means of these respectively separately allocated locking elements or a combined locking element, can also be provided.

Reference is also made to the fact that the principles of the invention can also be applied to a soil compactor in which also or alternatively a compaction roller is rotatably supported on a corresponding frame at the rear end and can thus also be driven, for example, for rotation and thus for propulsion of the compactor. A cross frame section of such a rear end comprising a compaction roller can also be utilized to make available the storage space or also to make available a work step in the sense of the invention.

The invention claimed is:

1. A soil compactor, comprising:

a compaction roller supported on a compaction frame and rotatable around a rotational axis, said compaction frame comprising longitudinal frame areas on both sides of said compaction roller in the direction of the rotational axis and a first cross frame area connecting said longitudinal frame areas to each other and extending essentially in the direction of the rotational axis;

at least one storage space provided in the first cross frame area said at least one storage space being open in upward direction by means of an upper opening area and being open in a direction facing away from said compaction roller by means of a lateral opening area; and a locking element movable between a closed position and an open position for closing said at least one storage space in the closed position, said locking element comprising a first locking element section closing said lateral opening area in the closed position, and a second locking element section bent at an angle with respect to said first locking element section and locking said upper opening area in the closed position, said first locking element section being pivotably connected to said first cross frame area in an area located underneath said lateral opening area, and a work step being providing by said second locking element section being essentially horizontally oriented when said locking element is positioned in the open position.

2. The soil compactor according to claim 1, wherein said longitudinal frame areas are connected to each other by means of a second cross frame area in such a way that said compaction roller is arranged between said first cross frame area and said second cross frame area, wherein said second cross frame area is preferably pivotally connected to a rear end and wherein a drive unit or/and a driving cab is provided at said rear end.

3. The soil compactor according to claim 1, wherein at least one preferably exchangeable roller tool is or can be positioned on an outer periphery of said compaction roller.

4. The soil compactor according to claim 1, wherein at least one holding handle preferably extending in the direction of the rotational axis is provided on said first cross frame area.

5. The soil compactor according to claim 4, wherein at least one track indication element is displaceably supported on at least one holding handle in the longitudinal direction of said holding handle.

6. The soil compactor according to claim 1, wherein at least one actuator is associated with said locking element for moving said locking element between the closed position and the open position.

7. The soil compactor according to claim 6, wherein said at least one actuator is activated with compressed fluid.

8. The soil compactor according to claim 6, wherein said locking element is locked in place by said at least one actuator when said locking element is positioned in the open position.

9. The soil compactor according to claim 6, wherein said locking element is locked in place by said at least one actuator when said locking element is positioned in the closed position.

* * * * *